US006968899B1

(12) United States Patent
Poldervaart et al.

(10) Patent No.: US 6,968,899 B1
(45) Date of Patent: Nov. 29, 2005

(54) DRILLING-WORKOVER VESSEL HAVING A DRILL STRING EXTENDING THROUGH AT LEAST ONE SWIVEL

(75) Inventors: Leendert Poldervaart, La Turbie (FR); René Perratone, Menton (FR); Hein Wille, Eze (FR)

(73) Assignee: Single Buoy Moorings Inc., Marly (CH)

( * ) Notice: Subject to any disclaimer, the term of this patent is extended or adjusted under 35 U.S.C. 154(b) by 416 days.

(21) Appl. No.: 10/111,770

(22) PCT Filed: Oct. 26, 2000

(86) PCT No.: PCT/EP00/10700

§ 371 (c)(1),
(2), (4) Date: Aug. 28, 2002

(87) PCT Pub. No.: WO01/31164

PCT Pub. Date: May 3, 2001

(30) Foreign Application Priority Data

Oct. 27, 1999 (EP) ..... 99203535
May 1, 2000 (EP) ..... 00201573

(51) Int. Cl.[7] ..... E21B 29/12
(52) U.S. Cl. ..... 166/355; 166/352; 166/366; 405/224.2; 405/169
(58) Field of Search ..... 166/352, 355, 166/358, 366, 367; 175/5, 7, 8; 405/224.5, 405/224.3, 224.4, 169, 170; 114/230.12, 114/230.13

(56) References Cited

U.S. PATENT DOCUMENTS

| | | | | |
|---|---|---|---|---|
| 3,602,302 | A * | 8/1971 | Kluth | 166/336 |
| 4,436,048 | A * | 3/1984 | Gentry et al. | 114/230.12 |
| 4,436,451 | A * | 3/1984 | Anderson | 405/224.2 |
| 4,448,568 | A * | 5/1984 | Gentry et al. | 405/168.3 |
| 4,762,185 | A * | 8/1988 | Simpson | 175/5 |
| 5,951,061 | A | 9/1999 | Arlt, III et al. | |
| 6,220,787 | B1 * | 4/2001 | Tanabe et al. | 405/169 |
| 6,708,639 | B2 * | 3/2004 | Cottrell et al. | 114/230.12 |
| 2004/0042856 | A1 * | 3/2004 | Erstad | 405/224.2 |
| 2004/0244986 | A1 * | 12/2004 | Poldervaart et al. | 166/367 |

FOREIGN PATENT DOCUMENTS

| | | |
|---|---|---|
| EP | 0 945 587 A1 | 9/1999 |
| GB | 2236417 A | 10/1999 |
| WO | WO 97/06049 | 2/1997 |
| WO | WO 99/17983 | 4/1999 |
| WO | WO 99/44883 | 9/1999 |

* cited by examiner

*Primary Examiner*—Thomas B. Will
*Assistant Examiner*—Thomas A Beach
(74) *Attorney, Agent, or Firm*—Young & Thompson

(57) ABSTRACT

A vessel (1) comprises a rotatable turret (14) and a supporting structure (3) over or on the turret for supporting a swivel (5). The swivel comprising an inner and an outer ring (21, 21'; 22, 22') which can rotate with respect to each other and which define at least one fluid distribution path from a geostationary fluid riser (19) connected to one ring (22, 22') to a product outflow pipe (18) connected to the other ring (21, 21'). A rig (2) is mounted over the turret area above or below the swivel (5), and a substantially rigid pipe extends from the rig, through a moonpool of the turret towards the sea bed, the rigid pipe being in line with the swivel.

15 Claims, 7 Drawing Sheets

DRILLING-WORKOVER VESSEL HAVING A DRILL STRING EXTENDING THROUGH AT LEAST ONE SWIVEL

FIELD OF THE INVENTION

The invention relates to a vessel comprising a rotatable turret and a supporting structure over or on the turret for supporting a swivel having an inner and outer ring which can rotate with respect to each other and which define at least one fluid distribution path from a geostationary fluid riser connected via piping to one ring, to a product outflow pipe connected to the other ring. From EP 371 668 a swivel stack is known which is placed out of the path of the drill string whenever drilling or workover activities take place, and which is connected to the risers and product piping via flexible piping.

OBJECT OF THE INVENTION

It is an object to provide a drilling and/or a workover vessel in which free access to the supporting deck of the rig is achieved for pipe handling during drilling or workover and in which the fluid risers and product piping can be interconnected relatively easily while drilling or workover operations are in progress. It is a further object to provide a drilling-workover vessel that combines drilling-workover with an (early) hydrocarbon production system while having semi- or full weathervaning capacities.

SUMMARY OF THE INVENTION

Hereto the drilling-workover vessel according to the invention is characterised in that a rig is mounted above the turret, above or below the swivel, a rigid pipe extending from the rig, through a moonpool of the turret towards the seabed, the rigid pipe being in line with the swivel.

In case a workover rig is used, a relatively small diameter workover pipe having a diameter varying normally between 5 and 6 inch, extends to the seabed. The compact workover rig can be placed under swivel stack. In case the rig is formed by drilling rig, a relatively large diameter drilling riser having a diameter of about 1 m, including buoyancy, is supported by the rig, the swivel being placed in the path of the drill string which extends through the central part of the swivel, and which may have a diameter of 4–10 inch. A drilling riser may be situated around the drill string. The drilling riser may form a protective housing for the drill string between a blow out preventor located at seabed level and a diverter at the top of the drilling riser, normally located at the drilling rig support structure level. By drilling through the swivel, the swivel can remain placed in the optimal position with respect to the vessel weathervaning point. Placing the swivel around the drill string and drilling riser maintains maximal access to the drilling rig supporting deck.

Preferably a protection pipe, or jacket is placed inside the central swivel part for protection of the swivel rings during drilling. By the protection pipe, it is prevented that the drill string or the drilling riser damages the swivels by inadvertent contact of the drill string or drilling riser with the swivel.

A flexible joint, such as a ball joint is provided in the drilling riser below or above the swivel stack to divert the drilling riser and the drill string at the required angle with respect to the vertical orientation.

The term "vessel" as is used herein, is intended to comprise floating constructions such as ships, barges, buoys, semi-submersibles and the like.

BRIEF DESCRIPTION OF THE DRAWINGS

The invention will be explained in detail under reference to the enclosed figures.

DETAILED DESCRIPTION OF THE INVENTION

Figure 1:
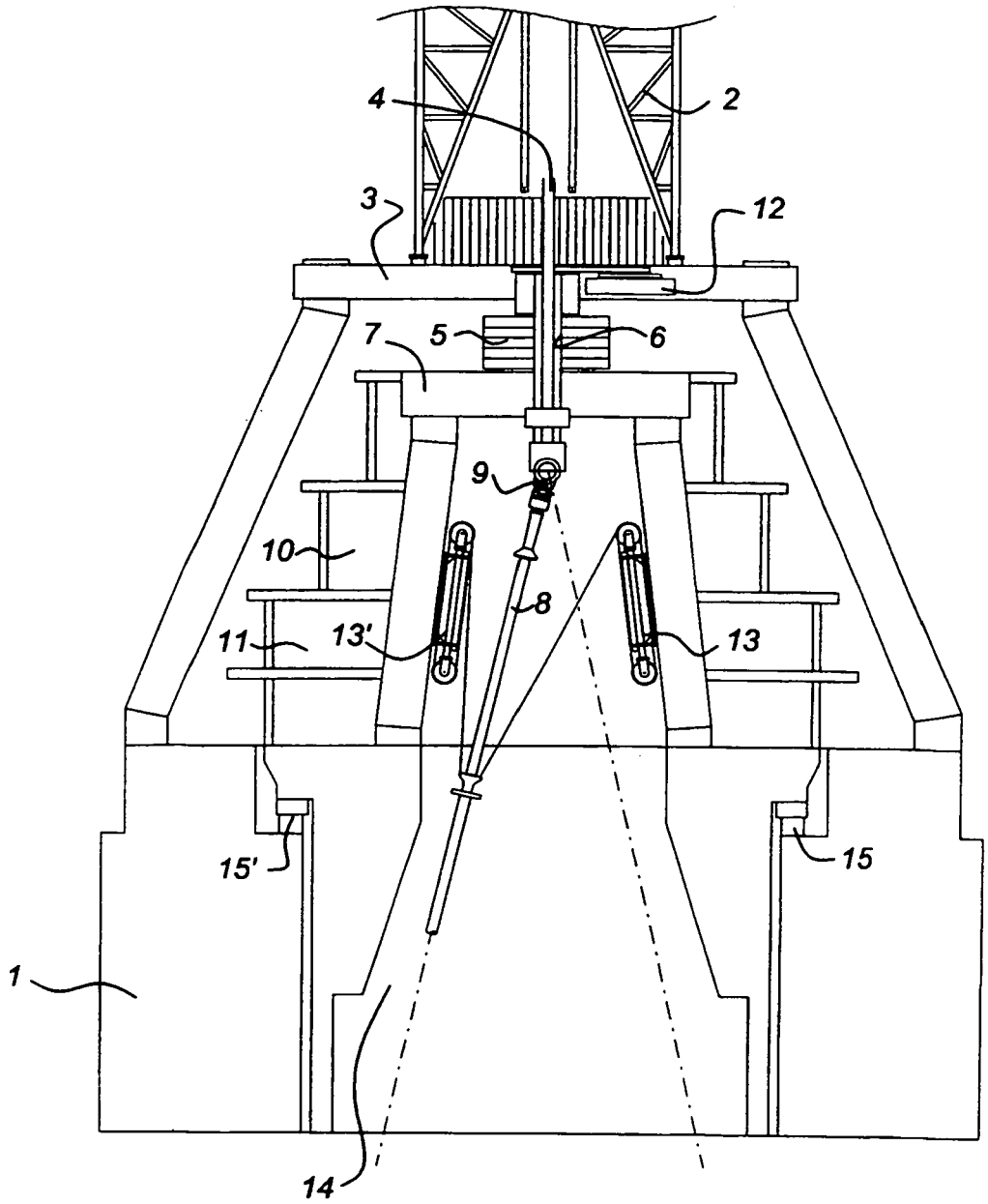
FIG. 1 shows a drilling-workover vessel, wherein the swivel stack is suspended from a derrick support structure.

FIG. 1 shows a drilling-workover vessel 1, such as a floating production drilling storage and offloading (FPDSO) vessel. A rig or derrick 2 is supported on a derrick supporting deck 3, which is placed on the vessel 1, over the area of a turret 14, supported by axial-radial bearings 15, 15'. A drill string 4 passes through the central hollow part 6 of a swivel stack 5, which in this embodiment comprises multiple swivels. The drill string could be driven by a turntable 12. The swivel stack is hanging from the derrick supporting deck 3, and may additionally, or instead, be supported by second support structure 7 on the turret. The equipment area 10 and the manifold room 11 are located around the second support structure 7 on the turret 14 which is geostationary and around which the vessel 1 can weathervane.

Below the swivel stack 5 is a ball joint 9 in a drilling riser 8, for deflecting the drilling riser and drill string at the desired angle, normally up to plus and minus several degrees around the vertical. The drilling riser 8 is maintained in its desired position by tensioners 13,13', which are mounted on the second support structure 7.

Figure 2:
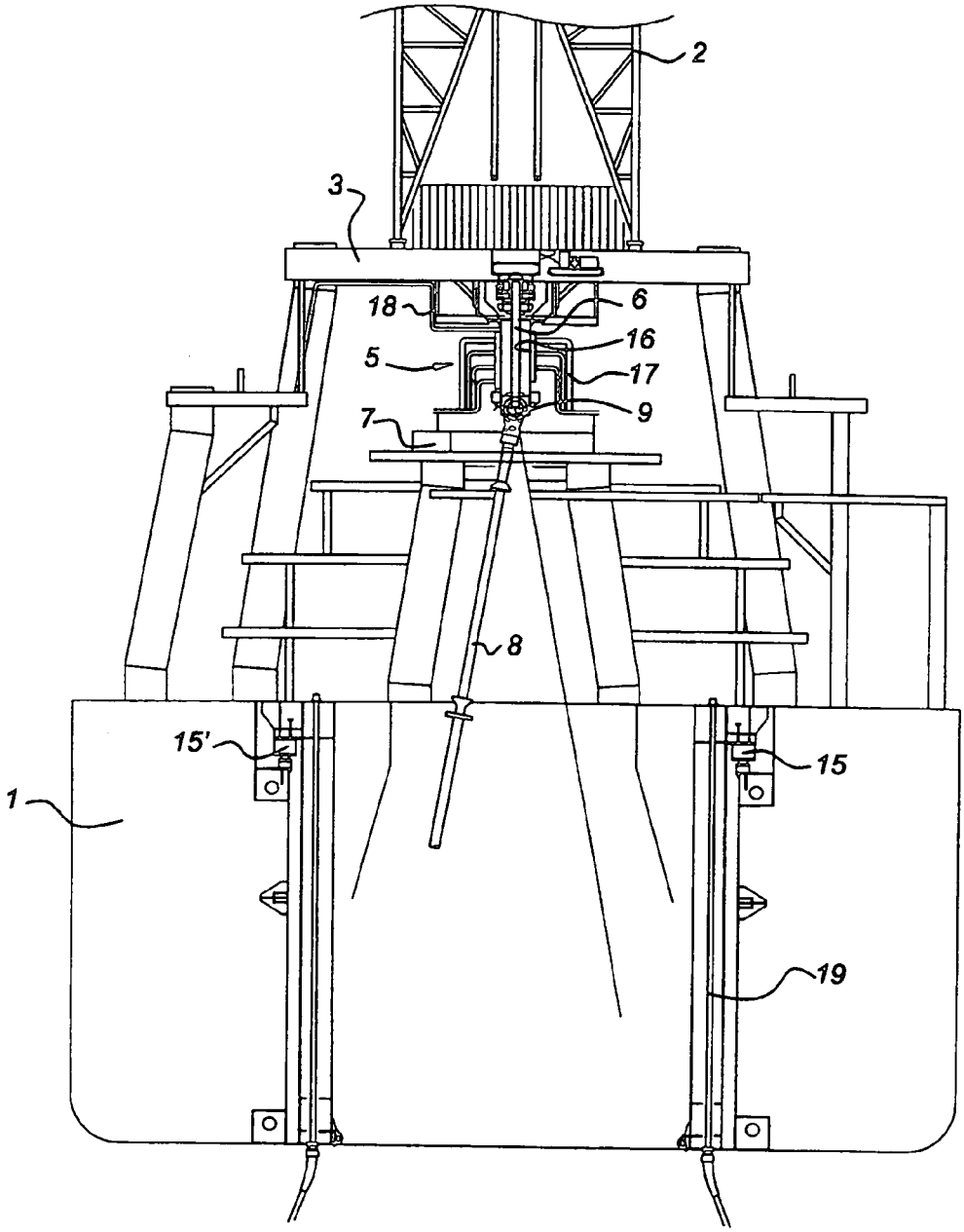
FIG. 2 shows an alternative embodiment of a drilling-workover vessel wherein a ball joint is provided near the lower end of the swivel stack.

As can be seen in FIG. 2, the ball joint 9 is directly coupled to a protective tube 16 that is placed within the swivel stack 5, but which is decoupled therefrom. The swivel stack 5 comprises inlets 17 which are connected to fluid risers 19 via fluid piping, and an outlet 18 connected to fluid piping on the vessel 1.

Figure 3:
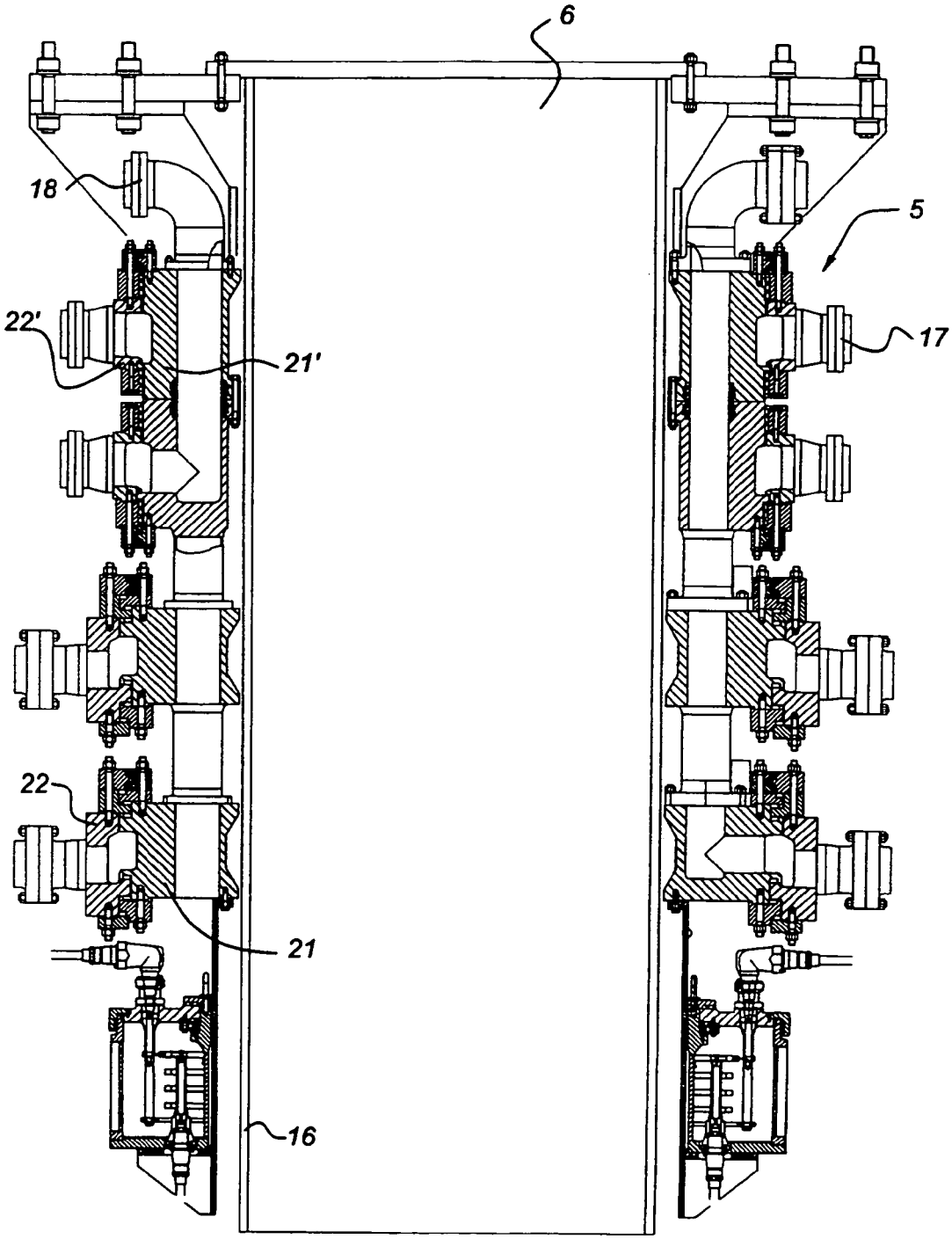
FIG. 3 shows a longitudinal cross section through a swivel stack according to the present invention.

FIG. 3 shows in detail the swivel stack 5, the central space 6 of which has a large diameter (for instance about 0,5 m, preferably 1,5 m or more) to accommodate in this case the drilling riser 8. The inlets 17 and outlets 18 of the swivels 5 are all located outside of the protective tube 16 that is placed on the inside of the swivels 5, that are defined by inner rings 21, 21' and outer rings 22, 22'. The inner rings 22, 22' are not directly in contact with the protective tube 16 so that the loads from the drilling riser 8 and the ball joint 9 are not transferred to the swivels 5.

In order to reduce the flow/workover/drilling down time whenever one or more of the swivels must be replaced for maintenance or repair purposes, a complete extra swivel stack can be held standby.

Figure 4:
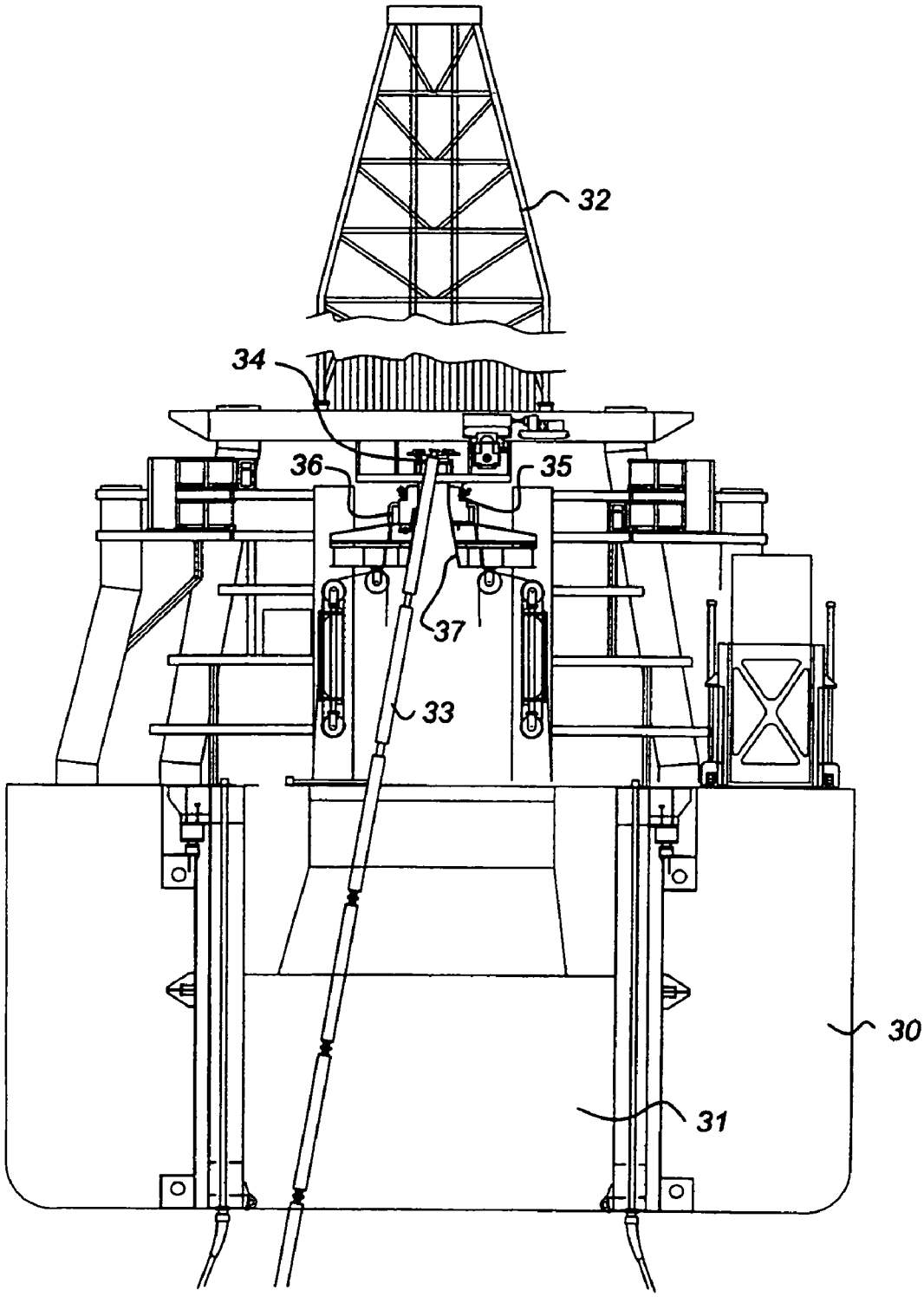
FIG. 4 shows an embodiment wherein a drilling riser with drill string extends through a swivel stack with an inner diameter, which increases towards the lower end of the drill string.

FIG. 4 shows a drilling-workover vessel 30 having a drilling rig 32 located over the turret mooring construction 31. In this embodiment the drilling riser 33 is suspended from a pivot point 34 located above a swivel stack formed by upper swivel 35 and lower swivel 36, the swivels being supported by a swivel support structure directly on the turret. The number of swivels in the stack is not limited to two, but can comprise any number that is necessary for efficient operation of drilling-work over vessel 30. The swivels 35, 36 are mounted around, but not directly connected to, a protective jacket 37 which has a tapering shape such as to allow deflection of the drilling riser 33 through an angle up to 20 degrees, preferably about 10 degrees, without colliding with the inner swivel walls. Thereby it is prevented that the outer buoyancy of drilling riser 33 is damaged or that the swivels are damaged or deformed by contact with the drill string or drilling riser 33.

Figure 5:
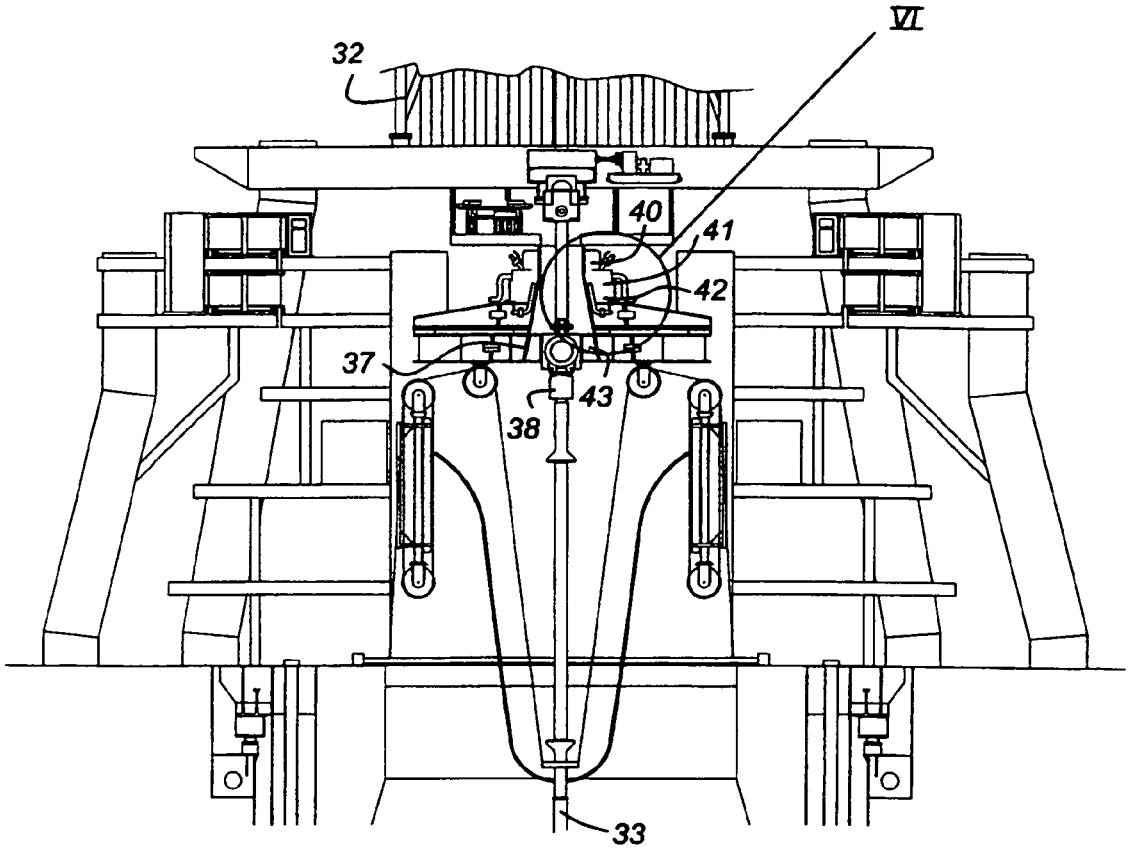
FIG. 5 shows an embodiment of the type shown in FIG. 4, the drilling riser having a ball joint located below the swivel stack.

In the embodiment shown in FIG. 5, a ball joint 38 is located near the lower, widest part of the jacket 37 for allowing deflection of the drilling riser 33 attached to said ball joint 38. It is obvious that the ball joint 38 could also be placed above the swivelstack.

Figure 6:
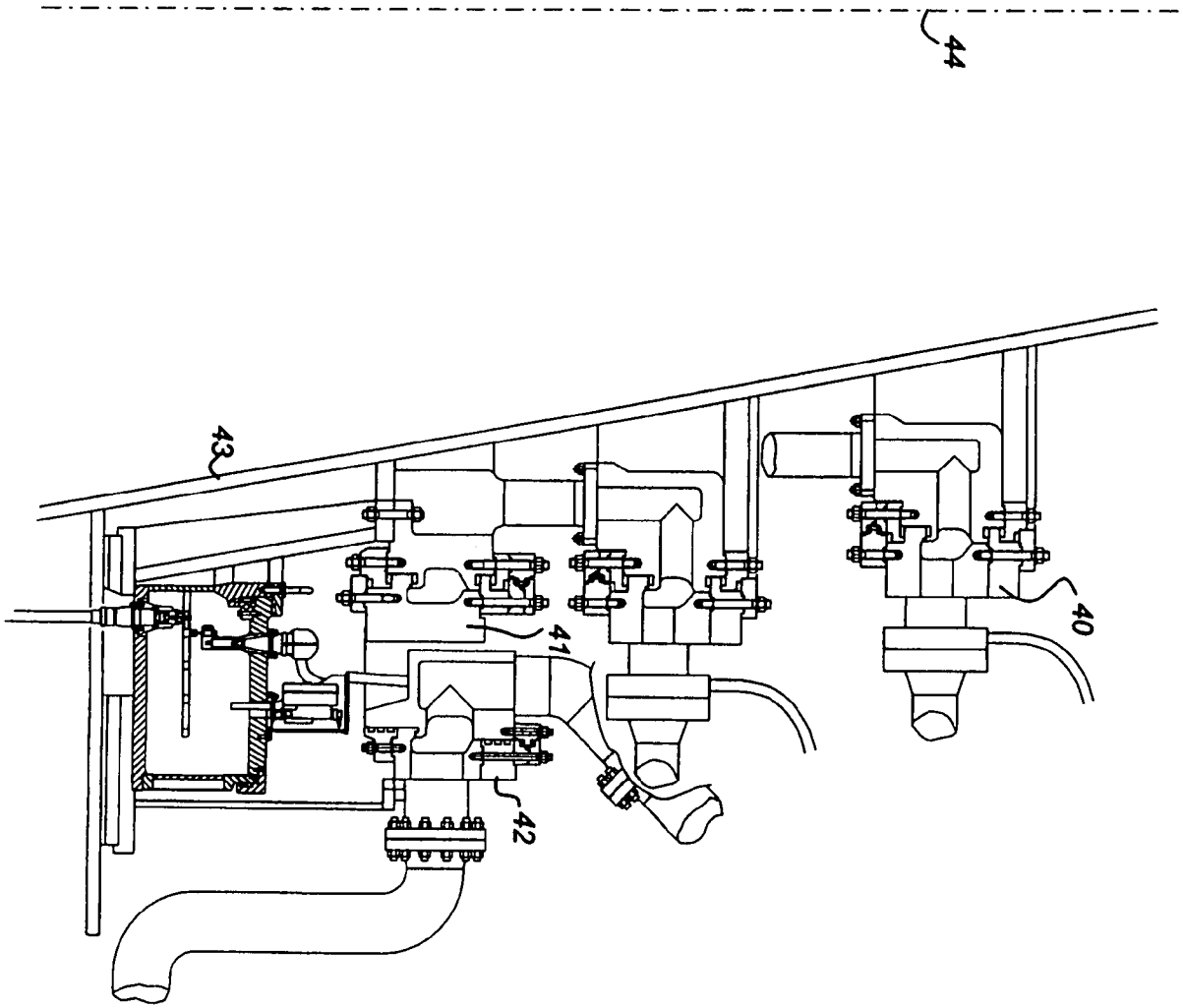
FIG. 6 shows an enlarged detail of one half of the swivel stack of FIG. 1.

FIG. 6 shows the swivels 40, 41, 42 of FIG. 5 on an enlarged scale. It can clearly be seen that swivels 40, 41, 42 are located at different radial positions along a longitudinal centreline 44, around which the swivels are rotationally symmetric. The inner protective jacket 43 has a tapering configuration which widens towards the lower end of the drill string or drilling riser located therein can be clearly seen from FIG. 6.

Not shown but within the scope of invention is the embodiment in which the drilling riser ends under (or near) the swivel stack. In this embodiment the divider, which closes the drilling riser at the top, is also placed under the swivel stack and only the drill string is extending through the swivel stack. The swivels could be directly stacked onto each other, could be arranged in an external support frame (stackless swivel configuration) or they could be in a concentric arrangement.

Figure 7:
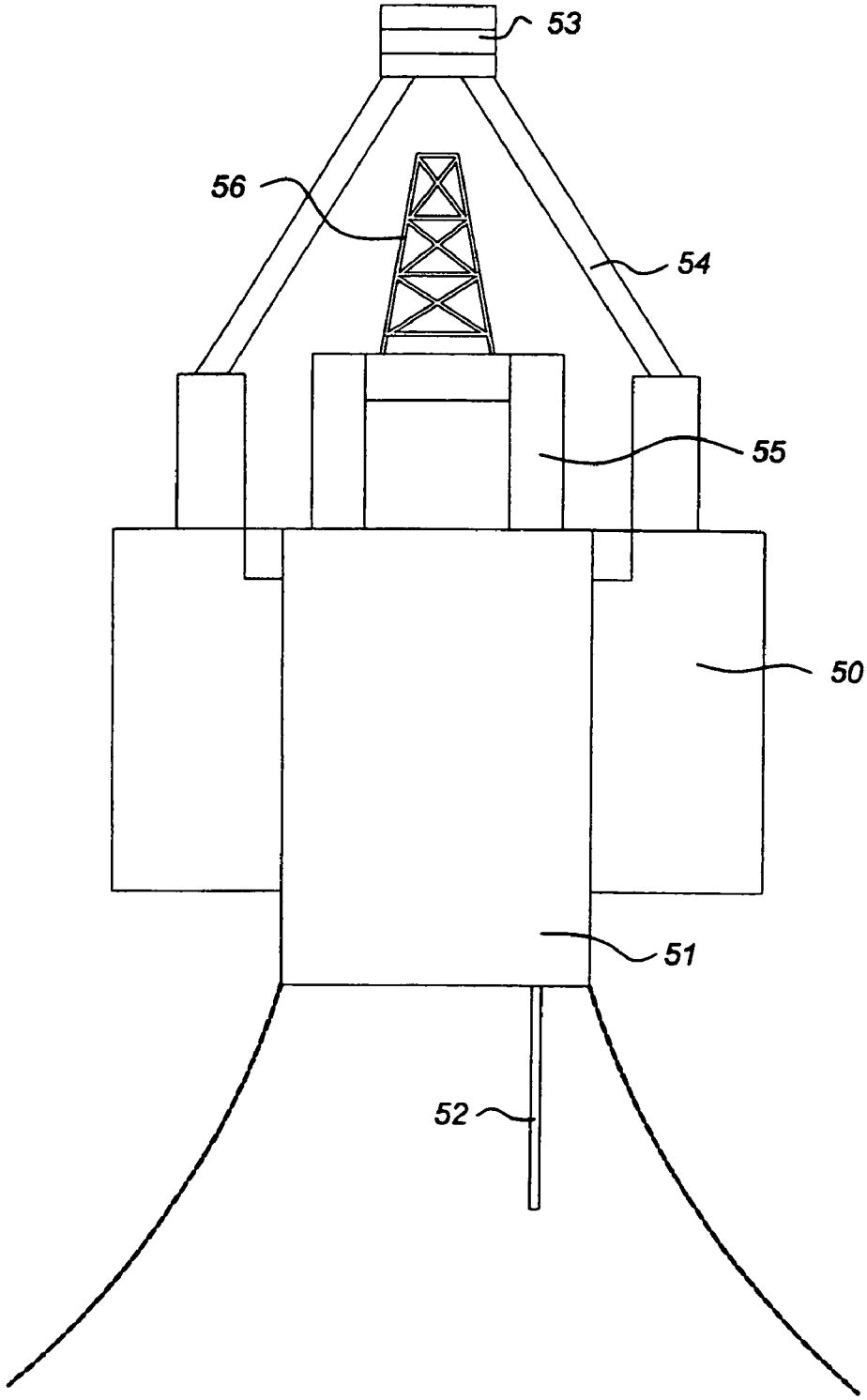
FIG. 7 shows an embodiment of a turret of a workover vessel according to the invention.

Finally, FIG. 7 shows an embodiment of a vessel 50 being moored by means of a rotatable turret 51, through which risers 52 extend to the seabed. A swivel stack 53 is supported on a supporting structure 54 over the turret 51 to be rotatable with the vessel 50 with respect to the turret 51. On a rig supporting structure 55 a relatively small workover rig 56 is placed from which a workover pipe is suspended. The workover rig 56 is of relatively small construction so that it can be accommodated underneath the swivel stack 53, generally in line with said swivel stack. The workover rig can be of such a size that it is integrated in the turret 51.

What is claimed is:

1. Drilling-workover vessel (1) comprising a rotatable turret (14) and a supporting structure (3) over or on the turret for supporting a swivel (5) having an inner and outer ring (21, 21'; 22, 22') which can rotate with respect to each other and which define at least one fluid distribution path from a geostationary fluid riser (19) connected via piping to one ring (22, 22'), to a product outflow pipe (18) connected to the other ring (21, 21'), characterised in that a rig (2) is mounted over the turret area, a substantially rigid pipe extending from the rig, through a moonpool of the turret towards the sea bed, the rigid pipe being in line with the swivel.

2. Drilling-workover vessel (1) according to claim 1, the rig (2) being supported on the structure (3), the pipe (4) extending from the rig (2) through the moonpool in the turret towards the seabed characterised in that the swivel (5) is placed below the rig in the path of the pipe (4), the pipe extending through the central part (6) of the swivel.

3. Drilling-workover vessel (1) according to claim 1, characterised in that the swivel (5) is suspended from the supporting structure (3).

4. Drilling-workover vessel (1) according to claim 2, characterised in that the swivel (5) is supported on a swivel supporting structure (7) below the rig supporting structure (3).

5. Drilling-workover vessel (1) according to claim 1, characterised in that at least two swivels are interconnected to form a swivel stack.

6. Drilling-workover vessel (1) according to claim 1, characterised in that a protection pipe (16) is placed inside the central swivel part (6) for protection of the swivel rings during drilling or workover and/or riser deployment.

7. Drilling-workover vessel (1) according to claim 1, characterised in that the drilling riser (8) extends through the swivelstack and comprises a flexible joint (9) located near the lower end of the swivel (5).

8. Drilling workover vessel (1) according to claim 1, characterized in that the drilling riser (8) extends through the swivel stack and comprises a joint (9) located below the swivel (5).

9. Drilling-workover vessel (1) according to claim 1, characterised in that the drilling riser (8) is connected to tensioning means (13,13') placed on the turret supporting structure (7).

10. Drilling-workover vessel (1) according to claim 1, characterised in that the inner diameter of the inner ring (21,21') of the swivel is at least 50 cm, preferably at least 2 meters.

11. Drilling-workover vessel (1) according to claim 1, a fluid inlet (17) and a fluid outlet (18) of the swivel being both located outside the central space (6).

12. Drilling-workover vessel (1) according to claim 1, characterised in that it comprises a complete extra swivel stack for change out purposes.

13. Drilling-workover vessel (30) according to claim 1, wherein the drill string (4) extends through the central part (6) of a swivel stack of at least two swivels (35, 36), the upper swivel (35) being of smaller inner diameter than the lower swivel (36).

14. Drilling-workover vessel (30) according to claim 1, wherein the substantially rigid pipe (33) extends through the swivel stack and can pivot around a pivot point (34) near or above the topmost swivel (35) of a swivel stack of at least two swivels (35, 36), the upper swivel (35) being of smaller inner diameter than the lower swivel (36) for allowing the rigid pipe (33) to pivot around the pivot point (34).

15. Drilling-workover vessel (30) according to claim 14, wherein the swivels are placed around a protection jacket (37) which has a larger diameter near the lower swivel (36) than near the upper swivel (34).

* * * * *